United States Patent [19]

Saito

[11] 4,018,862

[45] Apr. 19, 1977

[54] METHOD FOR PRODUCING NON-WOVEN FABRIC

[75] Inventor: Satoru Saito, Nagaokakyo, Japan

[73] Assignee: Dynic Corporation, Kyoto, Japan

[22] Filed: Oct. 4, 1974

[21] Appl. No.: 512,293

[30] Foreign Application Priority Data

Oct. 6, 1973 Japan ..... 48-111949

[52] U.S. Cl. ..... 264/137; 264/122; 264/342 R

[51] Int. Cl.[2] ..... B29G 5/00

[58] Field of Search ..... 264/342 R, 122, 137

[56] References Cited

UNITED STATES PATENTS

| | | | |
|---|---|---|---|
| 3,214,323 | 10/1965 | Russell et al. | 156/291 |
| 3,236,238 | 2/1966 | Morse | 264/342 R |
| 3,898,311 | 8/1975 | Mitchell et al. | 264/126 |

*Primary Examiner*—Robert F. White
*Assistant Examiner*—James R. Hall
*Attorney, Agent, or Firm*—Birch, Stewart, Kolasch and Birch

[57] ABSTRACT

A method for producing a non-woven fabric which comprises bonding webs comprising a hydrophilic or hydrophobic non-shrinkable fiber and a heat-shrinkable fiber (e.g., a dry heat-shrinkable fiber and a wet heat-shrinkable fiber) partially or in a pattern with a binder, heating rapidly the bonded webs and thereby shrinking the webs to give a bulky and soft non-woven fabric having high water absorption properties; when the web comprises a predominant hydrophilic fiber and a wet heat-shrinkable fiber, the web is preferably subjected to a pre-wetting prior to the print bonding.

5 Claims, No Drawings

METHOD FOR PRODUCING NON-WOVEN FABRIC

The present invention relates to a producing a non-woven fabric. More particularly, it relates to a method for producing a bulky, soft non-woven fabric having high water absorption properties, which comprises bonding partially fiber webs with a binder and then shrinking the bonded webs.

A non-woven fabric having comparatively many adhesive-free fibers on the surface has, hitherto, been produced by a print bonding method, i.e., by bonding partially or in a pattern fiber webs, particularly webs containing a hydrophilic fiber as the main component with a binder. The non-woven fabric thus obtained is soft and has high water absorption properties, and therefore, has been widely used.

According to the print bonding method, generally, a liquid or pasty binder is applied to the web by a print roll or a screen printing machine, and further in case of the web containing a hydrophilic fiber as the main component, the web is at first wetted and then an aqueous binder is applied thereto. The wetting of the web prior to the application of the binder is performed for the purpose of improving the penetration of the binder into the interior area or the reverse side of the web. However, the penetration of the binder into the web is still not sufficient, particularly in the case of a thick web, and therefore, a comparatively thin product has been merely produced by the conventional print bonding method. Thus, there has never been produced a bulky and thick non-woven fabric by a conventional method.

Although the non-woven fabric produced by the print bonding method has excellent characteristics such as a soft feeling and absorption characteristics, the print bonding method has a serious defect that a thick product can not be obtained.

Under the circumstances, the present inventor has intensively studied to find an improved method for producing a bulky and soft non-woven fabric, and has found that the desired non-woven fabrc can be produced by bonding partially the fiber webs containing a heat-shrinkable fiber with a binder and then shrinking the bonded webs, and that the non-woven fabric thus obtained has at least 4 times of the bulkiness and at least 2 times of the weight in comparison with the product obtained by a conventional print bonding method.

An object of the present invention is to provide an improvement of the print bonding method for producing a bulky non-woven fabric.

Another object of the invention is to provide a method for producing a bulky and soft non-woven fabric having high water absorption properties.

These and other objects of the invention will be apparent from the description hereinafter.

According to the present invention, the desired non-woven fabric can be produced by bonding webs comprising a non-shrinkable fiber (hereinafter, referred to as a main component fiber) and a heat-shrinkable fiber with or without wetting with a binder, penetrating the binder well into the reverse side of the webs, and then shrinking the webs while the binder is still sufficiently wetted. In the present method, the binder is partially printed or patterned on the comparatively thin webs and therefore penetrates well into the reverse side of the webs, and then the webs thus treated are shrunk by heat to give a non-woven fabric having increased weight and thickness, which can not be obtained by a conventional print bonding method.

The web used in the present invention comprises a non-shrinkable fiber and a heat-shrinkable fiber. The non-shrinkable fiber includes all of the fibers useful for producing a web, such as hydrophilic fibers and hydrophobic fibers. The hydrophilic fibers may be, for example, rayon, cotton, woodpulp, flax, ramie, etc. The hydrophobic fibers may be, for example, nylon, polyesters, polyacrylonitrile fiber, polypropylene fiber, etc. These hydrophilic fibers and hydrophobic fibers may be used alone or as a mixture thereof. When the non-shrinkable fiber is admixed with a wet heat-shrinkable fiber, it is preferable to use a non-shrinkable fiber comprising completely or predominantly a hydrophilic fiber or at least more than 50 parts by weight of a hydrophilic fiber on the basis of the total weight of the non-shrinkable fiber.

The heat-shrinkable fiber to be admixed with the non-shrinkable fiber includes a dry heat-shrinkable fiber (e.g., polyvinyl chloride fiber, ethylenevinyl acetate copolymer fiber, copolymer type nylon fiber, polypropylene fiber, or the like) which is rather easily shrunk with dry heat, and a wet heat-shrinkable fiber (e.g., polyvinyl alcohol fiber, polychlal fiber, wet heat-shrinkable polyester fiber, or the like). The dry heat-shrinkable or wet heat-shrinkable fiber may be mixed with the main component fiber, i.e, the non-shrinkable fiber in an appropriate ratio. The ratio of the mixture is not limited to a particular range, but the heat-shrinkable fiber may be preferably mixed in a range of 10 to 50 parts by weight on the basis of 100 parts by weight of the non-shrinkable fiber.

The binder used in the present invention may be a conventional one, for example an aqueous emulsion or an organic solution of a synthetic resin, such as synthetic rubbers (e.g., butadiene-styrene copolymer, butadiene-acrylonitrile copolymer, or butadiene-methyl methacrylate copolymer), polyacrylic esters (e.g., polymethyl acrylic ester, polyethyl acrylic ester, polybutyl acrylic ester, or a copolymer thereof), polyvinyl acetate, ethylene-vinyl acetate copolymer, or polyvinyl chloride, but in case of using a hydrophilic web, the binder should be an aqueous emulsion.

When the web comprises predominantly a hydrophilic fiber, it is usually subjected to a pre-wetting, i.e., it is wetted with water prior to the print bonding and thereby the web is more easily penetrated by the binder. Moreover, in the present invention, when a web containing a wet heat-shrinkable fiber is used, it is preferable to wet the web with water prior to the shrinkage with heat, because the shrinkage of the web containing a wet heat-shrinkable fiber can be carried out by raising the temperature of the water contained in the web higher than the temperature at which the wet heat-shrinkable fiber is shrunk. Thus, when a hydrophilic fiber is used as the main component fiber and further a wet heat-shrinkable fiber is used as the heat-shrinkable fiber, it is preferable to subject the web to the prewetting step from the viewpoint of shrinkage of the web, and further it is very important for effecting easy penetration of the binder into the web.

Thus, in case of using a hydrophilic web comprising a predominant hydrophilic fiber and a wet heat-shrinkable fiber, the present method is carried out by subjecting the webs to a pre-wetting, bonding the wetted webs partially or in a pattern with a binder, heating the bonded webs rapidly and thereby shrinking the webs to give a bulky and soft non-woven fabric.

The pre-wetting may be carried out by a conventional method, such as dipping in water and then squeezing the water, or by spraying it with water. The bonding of the webs may be carried out by a conventional method used in the conventional print bonding method, such as applying a liquid or pasty binder to the web partially or in a pattern by a print roll or a screen printing machine. For shrinking the webs, the bonded webs may be heated at a temperature of 30° to 200° C, preferably 40° to 170° C, more preferably 100° to 150° C for several seconds to a few minutes (e.g., 10 seconds to 1 minute) in a hot air oven, infrared heater, steam oven, or the like.

In the above hydrophilic web comprising a predominant hydrophilic fiber and a wet heat-shrinkable fiber, there may be admixed a small amount of a dry heat-shrinkable fiber.

Alternatively, the web used in the present invention may comprise a predominant hydrophilic fiber and a dry heat-shrinkable fiber, wherein a small amount of a wet heat-shrinkable fiber, may be contained. When a dry heat-shrinkable fiber is used as the heat-shrinkable fiber, the shrinkage of the bonded web is not affected by the presence or absence of water. Accordingly, when the web is the one containing a dry heat-shrinkable fiber, it need not be subjected to the prewetting step as in the case of using the web comprising a hydrophilic fiber and a wet heat-shrinkable fiber. However, the web may be subjected to the pre-wetting for effecting the penetration of the binder into the web. Instead of, the pre-wetting, the penetration of the binder may be achieved by suction as explained below as in the case of the web comprising predominantly a hydrophobic fiber.

In case of using such a web comprising a predominant hydrophilic fiber and a dry heat-shrinkable fiber, the present method is carried out by bonding the webs partially or in a pattern with a binder, heating the bonded webs rapidly at a temperature of 100° to 200° C, preferably 130° to 170° C for several seconds to a few minutes in a hot air oven, infrared heater, steam oven, or the like and thereby shrinking the webs to give a bulky and soft non-woven fabric.

Moreover, when the web comprises predominantly a hydrophobic fiber, it can not be subjected to the pre-wetting.

Thus, in case of using a web comprising a predominant hydrophobic fiber and a dry heat-shrinkable fiber, the present method may be carried out by bonding the webs partially or in a pattern with a binder, heating the bonded webs rapidly and thereby shrinking the webs to give a bulky and soft non-woven fabric. Thus, in this case, the web is not treated for effecting the easy penetration of the binder into the interior area or the reverse side of the web, such as the pre-wetting as in the case of using a hydrophilic web comprising a predominant hydrophilic fiber and a wet heat-shrinkable fiber. Accordingly, in the case of using a hydrophobic web, the web is subjected to the print bonding while it is sucked by a suction apparatus installed under the conveyer, and thereby the penetration of the binder into the interior area of the web can be effectively achieved. In this method, it should be noted that the bonded web must be shrunk before the binder is cured. That is, the bonded web should be rapidly heated to the temperature at which the web is shrunk, for instance it is heated to the desired temperature for a few seconds to a few minutes (e.g., 5 seconds to 5 minutes, preferably 10 seconds to 1 minute), and thereby the web is shrunk prior to the curing of the binder.

In the above method, the bonding of the webs may be carried out in the same manner as when using a hydrophilic web, and for shrinking the webs, the bonded webs may be heated at a temperature of 100° to 200° C, preferably 130° to 170° C in a hot air oven, infrared heater, steam oven, or the like.

As mentioned above, when using a web comprising a predominant hydrophobic fiber and a dry heat-shrinkable fiber, the bonded web should be shrunk before the binder is cured, since when the bonded part of the web is dried and cured before the shrinkage, the shrinkage is hindered thereby. This is theoretically applied to the case when using a web comprising a predominant hydrophilic fiber and a wet heat-shrinkable fiber. However, in the case of the latter, the web is at first subjected to the pre-wetting and then the print bonding, and thereafter it is rapidly heated and thereby shrunk, and therefore, the shrinkage is effected before the bonded web is dried without being hindered.

Alternatively, the web may comprises a predominant hydrophobic fiber and a wet heat-shrinkable fiber, wherein a small amount of a dry heat-shrinkable fiber may be admixed. In such a case, the present method is carried out by bonding the webs partially or in a pattern with a binder, wherein the penetration of the binder into the webs is effected by suction as mentioned above, heating the bonded webs rapidly under an atmosphere of steam, for instance by using a steam oven at a temperature of 30° to 200° C, preferably 40° to 170° C, more preferably 100° to 150° C for 10 seconds to 1 minute and thereby shrinking the webs to give the desired non-woven fabric.

The non-woven fabric obtained by the present method is widely useful, for instance, as a mop, a floor-cloth, a filter cloth, a heat or electrical insulating material, a re-inforcement material for plastics, a hygienic material (e.g., diaper or napkin), etc.

The present invention is illustrated by the following Examples but is not limited thereto.

EXAMPLE 1

A web (80 g/m$^2$) is prepared from a fiber comprising a rayon (1.5 d × 38 mm; 80 parts by weight and a wet heat-shrinkable polyvinyl alcohol fiber (1.5 d × 38 mm; 20 parts by weight) by using a card and a cross lapper. The web is held between two wire cloths, and dipped in water and then treated with a mangle to squeeze the water therefrom (the squeezing rate: about 300 %) (these steps are the pre-wetting). The web thus treated is printed with an acrylic emulsion in a pattern of 2 mm in diameter and 3 patterns per cm$^2$ of the dispersion density by using a letterpress printing roll. The web is shrunk in a hot-air drier at 150° C, and then dried and cured to give a bulky non-woven fabric (the area: about ½ of the original one, the weight: 170 g/m$^2$), to which the binder is completely penetrated. In the above example, the total area of the web to which the binder is applied is about 30% calculated on the basis of the web after shrinkage.

EXAMPLE 2

A web (50 g/m$^2$) is prepared from a fiber comprising a nylon fiber (3 d × 51 mm; 70 parts by weight) and a dry heat-shrinkable polyvinyl chloride fiber (3 d × 51 mm; 30 parts by weight) by using a random webber. The web is printed with an acrylonitrile-butadiene rubber latex in a pattern of 1 mm in diameter and 5 patterns per $cm^2$ of the dispersion density by using a rotary screen type print roll with suction by a suction apparatus. The web is rapidly heated with an infrared heater and thereby shrunk, and then dried and cured to give a bulky non-woven fabric (the area: about ½ of the original one, the weight: 110 $g/m^2$), to which the binder is completely penetrated. In the above example, the total area of the web to which the binder is applied is about 50% calculated on the basis of the web after shrinkage.

EXAMPLE 3

A web (60 $g/m^2$) is prepared from a fiber comprising a cotton (70 parts by weight) and a dry heat-shrinkable ethylene-vinyl acetate copolymer fiber (4 d × 51 mm; 30 parts by weight) by using a random webber. The web is printed with a styrenebutadiene rubber latex in a pattern of 3 mm in diameter and 2 patterns per $cm^2$ of the dispersion density by using a rotary screen type print roll with suction by a suction apparatus. The web is heated at 170° C in a drier and thereby shrunk, and then dried and cured to give a bulky non-woven fabric (the area: about ½ of the original one, the weight: 130 $g/m^2$), to which the binder is completely penetrated into the reverse side of the web. In the above example, the total area of the web to which the binder is applied is about 40% calculated on the basis of the web after shrinkage.

EXAMPLE 4

A web (70 $g/m^2$) is prepared from a fiber comprising a polyester fiber (2 d × 38 mm; 60 parts by weight) and a wet heat-shrinkable polyester fiber (3 d × 51 mm; 40 parts by weight) by using a card and a cross lapper. The web is printed with an emulsion of ethylene-vinyl acetate copolymer in a pattern of 1.5 mm in diameter and 4 patterns per $cm^2$ of the dispersion density by using a rotary screen type print roll under suction by suction apparatus. The web, heated in an oven wherein steam is formed at a high temperature and at a high pressure is thereby shrunk, then dried and cured to give a bulky non-woven fabric (the area: about ½ of the original one, the weight: 150 $g/m^2$), to which the binder is completely penetrated into the reverse side of the web. In the above example, the total area of the web is applied the binder is applied is about 50% calculated on the basis of the web after shrinkage.

What is claimed is:

1. A method of making a bulky non-woven fabric, comprising:

a. Prewetting with water a web comprising:
   i. a hydrophilic non-shrinkable fiber, 100 parts by weight, and
   ii. a fiber which is heat shrinkable when wet, 10 to 50 parts by weight;
b. applying to portions of said wet web or in a pattern thereon, a curable binder in a liquid or pasty condition;
c. heating and shrinking said wet web while maintaining said binder in an uncured state to give a bulky non-woven fabric; and
d. drying said wet web to cure said binder, resulting in a finished bulky non-woven fabric.

2. The method according to claim 1, wherein the fiber which is heat-shrinkable when wet is a member selected from the group consisting of polyvinyl alcohol fiber, polychlal fiber and a polyester fiber which is heat-shrinkable when wet.

3. The method according to claim 1, wherein the heating of the web is carried out at a temperature of 40° to 170° C.

4. The method according to claim 3, wherein the heating is conducted at a temperature of from 100° to 150° C.

5. The method according to claim 1, wherein the hydrophilic non-shrinkable fiber is a member selected from the group consisting of rayon, cotton, wood-pulp, flax and ramic.

* * * * *